US007997525B2

(12) United States Patent
Hatcher et al.

(10) Patent No.: US 7,997,525 B2
(45) **Date of Patent: *Aug. 16, 2011**

(54) RETRACTABLE HOSE GUIDE

(75) Inventors: Stephen D. Hatcher, Camp Hill, PA (US); Joshua O. Mullen, Duncannon, PA (US); Darlene B. SantaCroce, Enola, PA (US)

(73) Assignee: Ames True Temper, Inc., Camp Hill, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/913,866

(22) Filed: Oct. 28, 2010

(65) Prior Publication Data

US 2011/0036937 A1 Feb. 17, 2011

Related U.S. Application Data

(63) Continuation of application No. 12/264,327, filed on Nov. 4, 2008.

(51) Int. Cl.
*B65H 23/04* (2006.01)

(52) U.S. Cl. ..... 242/615.2; 242/157 R

(58) Field of Classification Search ..... 242/615, 242/615.2, 157 R, 397.2; 254/405, 406, 254/415; 239/280, 281; 248/87
See application file for complete search history.

(56) References Cited

U.S. PATENT DOCUMENTS

| | | | | |
|---|---|---|---|---|
| 2,974,933 | A | 3/1961 | Belanger | |
| 3,081,978 | A * | 3/1963 | Kaufmann | 242/615.2 |
| 3,249,337 | A * | 5/1966 | Neumann | 242/615.2 |
| 3,829,065 | A * | 8/1974 | Less | 242/615.2 |
| 4,452,386 | A | 6/1984 | McElyea | |
| 4,815,645 | A | 3/1989 | Higgins | |
| 6,595,464 | B2 | 7/2003 | Peck | |
| 7,527,227 | B1 | 5/2009 | Mondello | |

* cited by examiner

*Primary Examiner* — Sang Kim
(74) *Attorney, Agent, or Firm* — Eckert Seamans Cherin & Mellott, LLC; David C. Jenkins, Esquire

(57) ABSTRACT

A retractable hose guide includes a shell assembly that is structured to be embedded into the ground. The shell assembly defines an enclosed space that is open at the top. A guide rod assembly is movably disposed within the shell assembly and structured to move between a first, retracted position, wherein the guide rod assembly is substantially disposed within the shell assembly enclosed space, and a second, extended position, wherein the guide rod assembly extends substantially above the shell assembly enclosed space. A pop-up device includes components on both the shell assembly and the guide rod assembly that act in concert to lock the guide rod assembly in either the first or second position. The pop-up device preferably includes a biasing device structured to bias the guide rod assembly toward the second, extended position. The pop-up device is structured to be actuated by a generally linear movement of the guide rod assembly.

13 Claims, 6 Drawing Sheets

RETRACTABLE HOSE GUIDE

CROSS REFERENCE TO RELATED APPLICATION

This application is a continuation of U.S. patent application Ser. No. 12/264,327, filed Nov. 4, 2008, entitled RETRACTABLE HOSE GUIDE.

BACKGROUND OF THE INVENTION

1. Field of the Invention

The present invention relates to a retractable hose guide, and more specifically, to a hose guide having a pop-up device that is actuated by a generally linear motion.

2. Background Information

A hose guide, in the most basic form, is a simple post embedded in the ground. A user places the hose on one side of the post to prevent the hose from being pulled over an adjacent area. Such posts are useful, but not typically attractive. One improvement to hose guides was to provide a decorative aspect, such as a finial or ornamental top. Other improvements included having a portion of the hose guide retract into the ground. Typically, such hose guides had a shell that was embedded in the ground and an extendable post. One disadvantage of retractable hose guides was that the extendable post needed to be manually pulled from the shell. See, e.g., U.S. Pat. No. 4,815,645. An improvement over this type of hose guide included a spring-biased extendable post. See, e.g., U.S. Pat. No. 6,595,464. The extendable post was locked in the retracted position by a tab or "key" disposed in a keyed slot. To release the extendable post the user was required to rotate the extendable post so that the key aligned with the keyhole. Such a maneuver, typically, required manipulation by the user's hands. Thus, while the spring eliminated the need to manually pull the extendable post from the shell, the locking feature still required a user to bend over or crouch in order to actuate the release. Additionally, when lowering the extendable post, the user was required to overcome the bias of the spring, as well as rotating the key through the key hole.

SUMMARY OF THE INVENTION

At least one embodiment of the disclosed invention provides a retractable hose guide having a pop-up device that is actuated by a generally linear motion. In this configuration, the user may extend or retract the extendable post using a generally linear motion of the foot. As such, the user is not required to bend over or crouch to manipulate the retractable hose guide. The retractable hose guide includes a shell assembly that is structured to be embedded into the ground. The shell assembly defines an enclosed space that is open at the top. A guide rod assembly is movably disposed within the shell assembly and structured to move between a first, retracted position, wherein the guide rod assembly is substantially disposed within the shell assembly enclosed space, and a second, extended position, wherein the guide rod assembly extends substantially above the shell assembly enclosed space. A pop-up device includes components on both the shell assembly and the guide rod assembly that act in concert to lock the guide rod assembly in either the first or second position. The pop-up device preferably includes a biasing device structured to bias the guide rod assembly toward the second, extended position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, the term "ground" means a substrate comprised of substantially granulated matter, such as, but not limited to, topsoil, dirt, clay, sand, or gravel.

As used herein, an "axial surface" is a surface that extends generally perpendicular to the longitudinal axis of the hose guide or relevant component.

As used herein, a "longitudinal surface" is a surface that extends generally parallel to the longitudinal axis of the hose guide or relevant component.

As used herein, directional terms, e.g., "above," "below," "upper," "lower," etc., are used for convenience relative to the figures and are not intended to limit the claims.

As used herein, "coupled" means a link between two or more elements, whether direct or indirect, so long as a link occurs.

Figure 1:
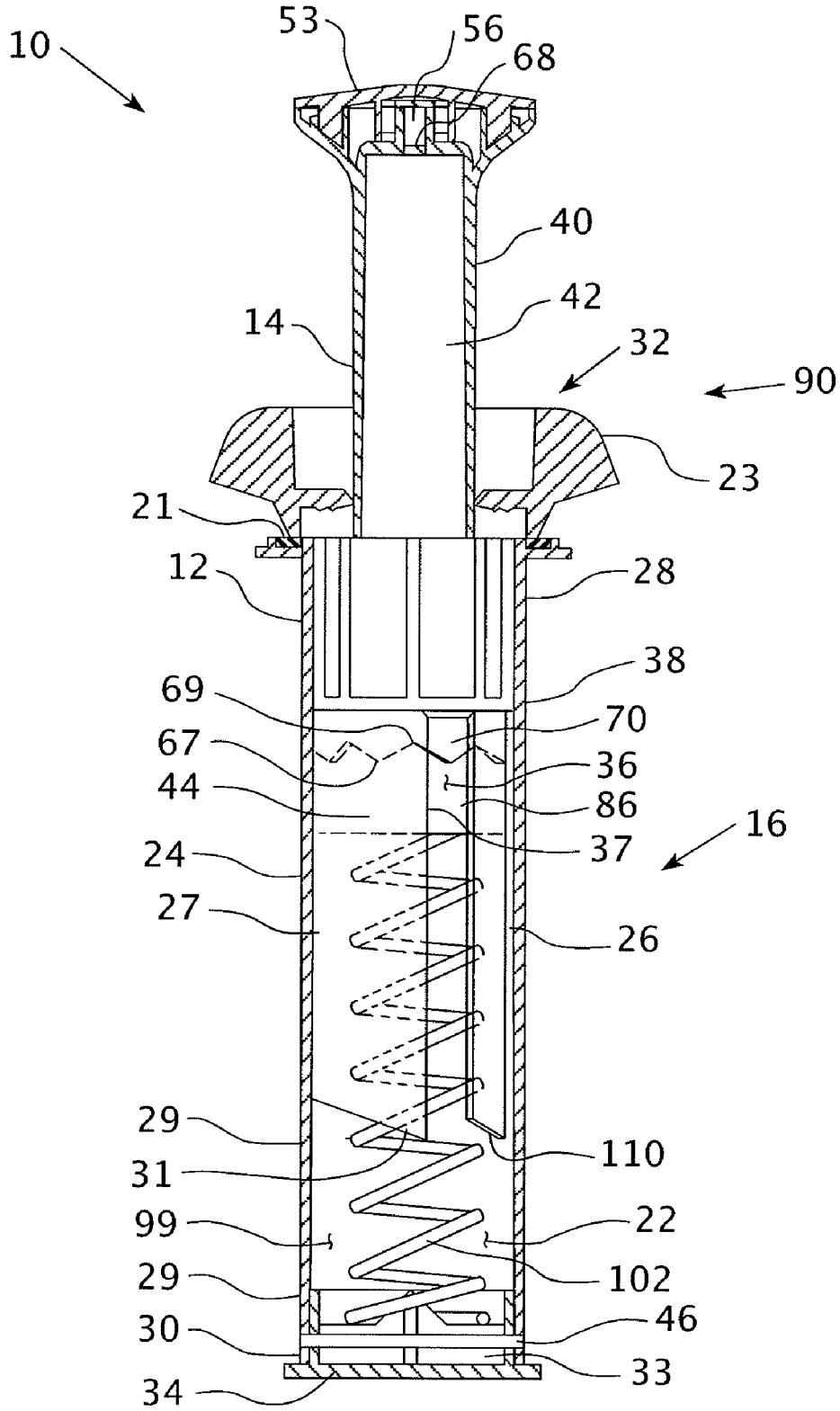
FIG. 1 is a partial cross-sectional side view of a hose guide in an extended position.
Figure 2:
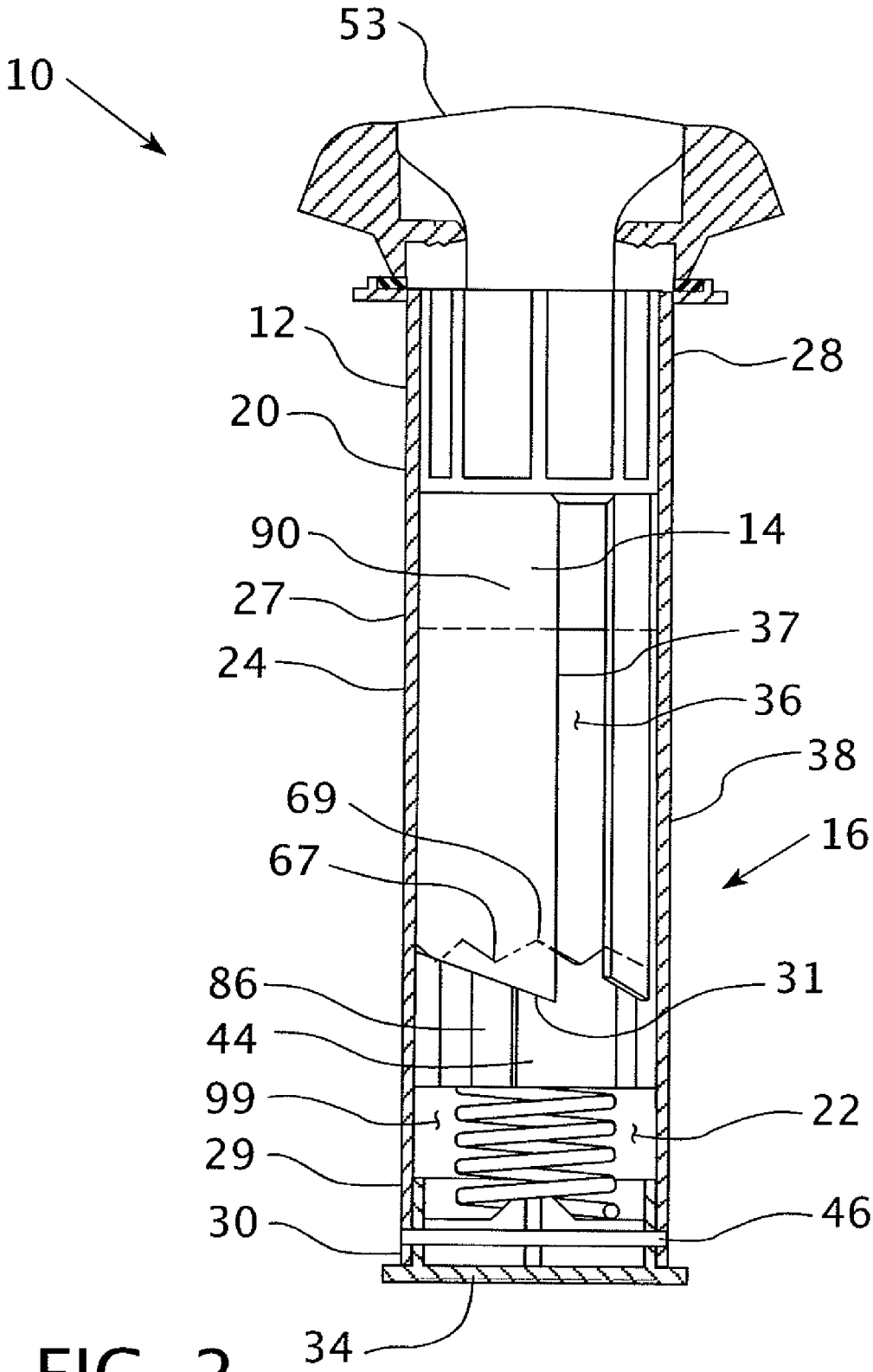
FIG. 2 is a partial cross-sectional side view of a hose guide in a retracted position.

As shown in FIGS. 1 and 2, a hose guide 10 includes a shell assembly 12, a guide rod assembly 14, and a pop-up device 16. The pop-up device 16 has a plurality of elements, described below, with some elements disposed on the shell assembly 12 and other elements disposed on the guide rod assembly 14. The pop-up device 16 will be described in detail below. The shell assembly 12 includes a body assembly 19 having a tubular body 20, a resilient retaining ring 21 and a collar body 23. The tubular body 20 is generally cylindrical and defines a substantially enclosed space 22. Preferably, the tubular body 20 has a sidewall 24 having an elongated, hollow, generally cylindrical shape. Such a tubular body 20 has an outer diameter, an inner side 26, an upper end 28, and a lower end 30. The tubular body 20 further has an upper portion 27 with a first thickness and a first inner diameter extending over a substantial portion of the tubular body 20. The tubular body 20 also has a lower portion 29 with a second thickness, which is thinner than the first thickness, and therefore, the tubular body lower portion 29 has a second, greater inner diameter. At the boundary between the tubular body upper portion 27 and the tubular body lower portion 29 is a downwardly facing axial surface 31. The axial surface 31 includes a plurality of cam surfaces 110, described below, which are elements of the pop-up device 16.

The tubular body 20 has an opening 32 disposed on the axial side of the tubular body upper end 28. The tubular body upper end opening 32 provides access to the tubular body enclosed space 22. The retaining ring 21 is disposed at the tubular body upper end 28. The retaining ring 21 has a central opening 25 that is slightly smaller than the tubular body upper end opening 32. Thus, the retaining ring 21 defines a circumferential stop edge 38 as well as allowing the spindle body 50 (discussed below) to pass therethrough. It is noted that, as the retaining ring 21 is resilient, the retaining ring 21 may be slightly biased against the spindle body 50 and may act as a squeegee that cleans the spindle body 50 as it moves between its first and second positions.

Figure 5:
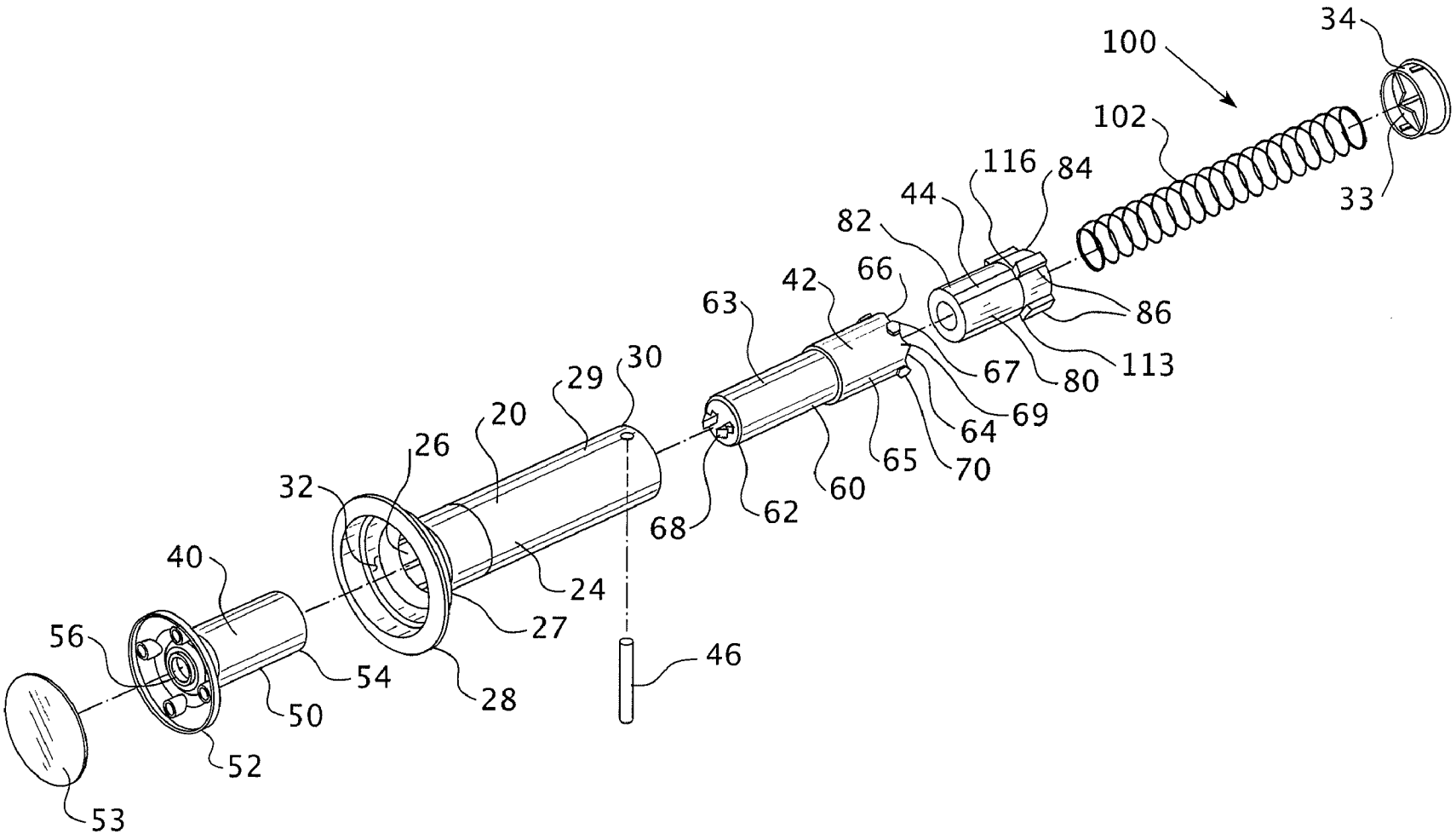
FIG. 5 is an exploded isometric view of another embodiment of the present invention.
Figure 6:
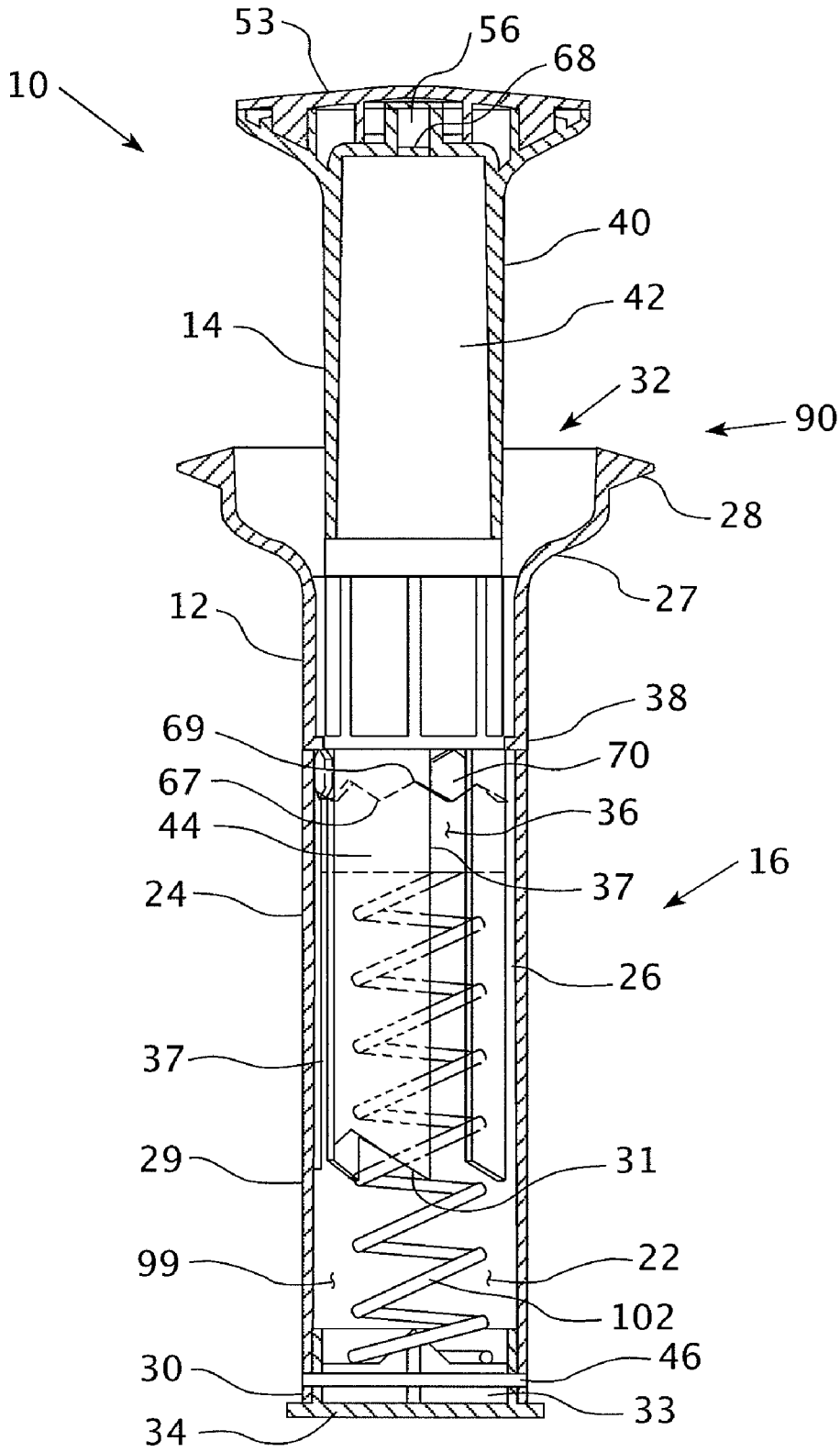
FIG. 6 is a partial cross sectional view of another embodiment of the hose guide.

The retaining ring 21 is held in place by the collar body 23. That is, the collar body 23 is coupled to the tubular body upper end 28 with the retaining ring 21 disposed therebetween. The collar body 23 is generally disk-shaped and has a greater cross-sectional area than the tubular body upper end 28. As shown in FIG. 5, in an alternate embodiment, the tubular body 20 may include a unitary flared upper portion 23A rather than having a separate collar body 23.

The tubular body lower end 30 may include a fixed cone, tapered point (not shown), or a rounded end cap 34. The tubular body lower end rounded end cap 34 is preferably a separate element that is coupled to the tubular body lower end 30. The tubular body upper portion 27 inner side 26 also includes at least one longitudinal race 36 having axial cam surfaces 37. The race 36 is, essentially, a groove in the tubular body upper portion 27. At the location of the race 36, the diameter is generally the same as the diameter of the tubular body lower portion 29. The at least one longitudinal race 36 and stop edge 38 are also elements of the pop-up device 16 as described below.

Figure 3:
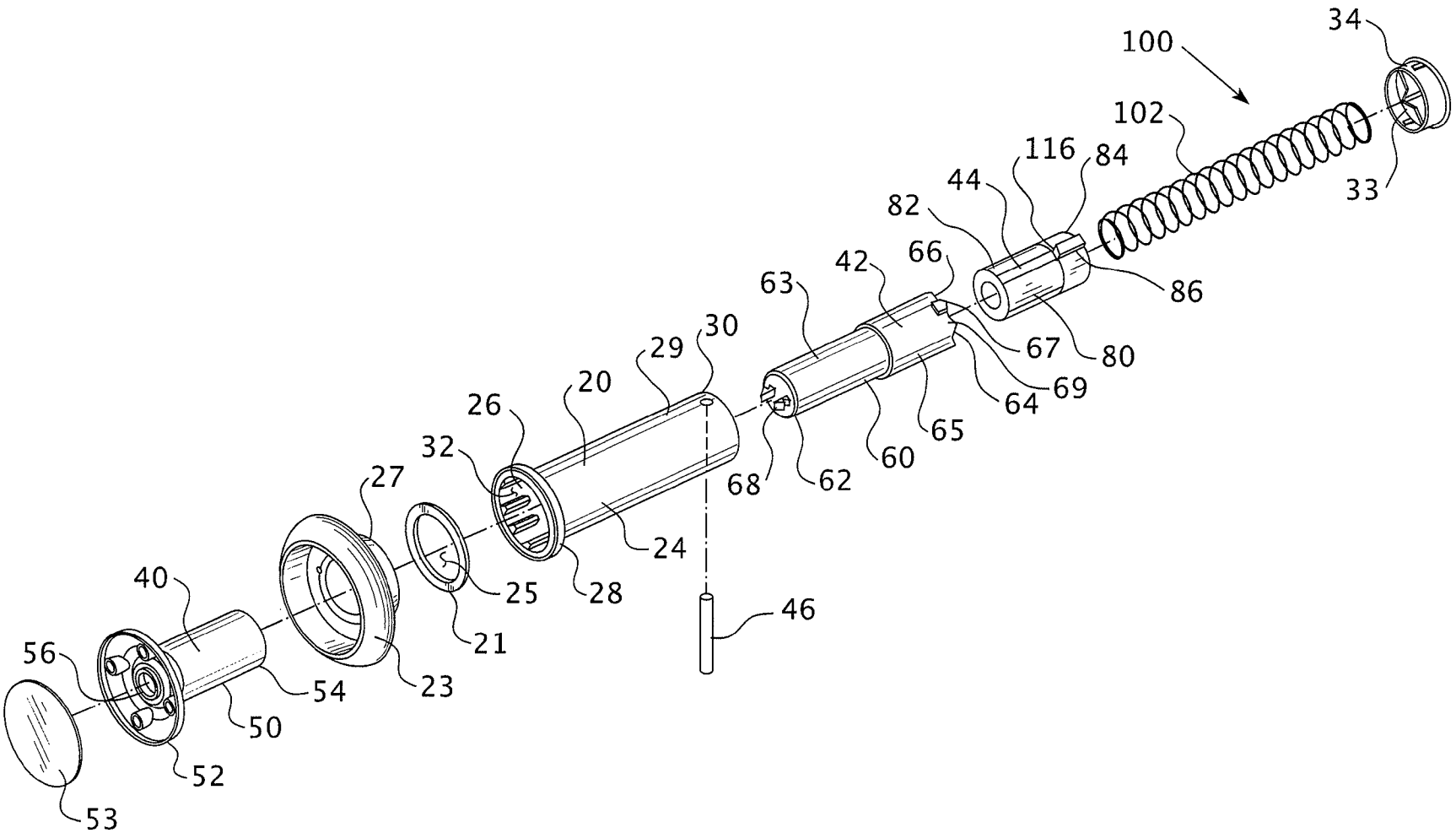
FIG. 3 is an exploded view of a hose guide.

As shown in FIG. 3, the guide rod assembly 14 includes a spindle 40, a spindle support 42, and a lock cam 44. The spindle 40 includes an elongated, hollow, generally cylindrical body 50 having an outer diameter, an inner diameter, an upper end 52, a lower end 54, and a coupling device 56. The spindle body 50 outer diameter is smaller than the tubular body 20 uniform diameter. As such, the spindle body 50 fits within the collar body 23 and the tubular body 20. The spindle body upper end 52 is flared to form a platform 53 that is wider than the spindle body 50 outer diameter but smaller than the collar body 23.

The spindle support 42 also has a generally cylindrical body 60 having an outer diameter, an upper end 62, a lower end 64 having a lower axial surface 66, a coupling device 68, and at least one bearing 70. The spindle support body lower end axial surface 66 and the at least one bearing 70 are elements of the pop-up device 16, described below. In the preferred embodiment, the spindle support body 60 also has an upper portion 63 and a lower portion 65. The spindle support body coupling device 68 is disposed at the spindle support body upper end 62. The spindle support body coupling device 68 is structured to be coupled to the spindle body coupling device 56. In the preferred embodiment, the spindle support body upper portion 63 is sized just smaller than the spindle body 50 inner diameter, and as such, may fit within the spindle body 50. The spindle support body lower portion 65 has an outer diameter that is substantially similar to the spindle body 50 outer diameter. At least the spindle support body lower portion 65 is hollow having an inner diameter.

The lock cam 44 has an elongated, generally cylindrical body 80 having an upper portion 82 with an outer diameter, a lower portion 84, and at least one cam extension 86. The at least one cam extension 86 is one of the pop-up device 16 elements, described below. The lock cam body upper portion 82 is sized just smaller than the spindle support body lower portion 65, and as such, may fit within the spindle support body lower portion 65. Preferably, the lock cam 44 is rotatably disposed in the spindle support 42 and maintained in place by a retaining pin 46. The at least one cam extension 86 extends radially beyond the radius of the lock cam body upper portion 82, and as such, is structured to abut the spindle support body lower end axial surface 66, as described below. The at least one cam extension 86 has a width that is structured to fit within the at least one longitudinal race 36, and preferably, abut the race axial cam surface 37, described below. The lock cam body lower portion 84 is structured to be engaged by a biasing device, such as, but not limited to, a spring 102, described below.

The hose guide 10 is assembled as follows. The spindle body lower end 54 is inserted through the collar body 23 and the tubular body upper end opening 32 and retaining ring central opening 25 into the enclosed space 22. The spindle support body upper end 62 is inserted through the tubular body lower end 30, prior to the coupling of the lower end rounded end cap 34 to the tubular body lower end 30. The spindle support body at least one bearing 70 is disposed within the tubular body at least one longitudinal race 36. The spindle body coupling device 56 and the spindle support body coupling device 68 are joined, thereby forming a spindle assembly 90 that is slidably disposed within the tubular body 20. Because the at least one bearing 70 is disposed within the tubular body at least one longitudinal race 36, the spindle assembly 90 slides linearly and does not rotate. The lock cam body upper portion 82 is then rotatably disposed within the spindle support body lower portion 65. Generally, the spindle assembly 90 has an outer diameter that is just smaller than the tubular body upper portion 27 inner diameter. Thus, because the tubular body lower portion 29 has a greater inner diameter than the tubular body upper portion 27 inner diameter, an annulus 99 exists between the tubular body lower portion 29 and the guide rod assembly 14. The at least one cam extension 86 extends into the annulus 99.

A biasing device, such as a compression spring 102, described below, is disposed between the lock cam body lower portion 84 and the lower end rounded end cap 34 and is coupled to the tubular body lower end 30. The spring 102 is compressed when the lower end rounded end cap 34 is coupled to the tubular body lower end 30. The lower end rounded cap 34 may have a spring support 33 structured to engage the spring 102. In this configuration, the guide rod assembly 14 is structured to move between a first, retracted position, wherein the guide rod assembly 14 is substantially disposed within the shell assembly enclosed space 22, and a second, extended position, wherein the guide rod assembly 14 extends substantially above the shell assembly enclosed space 22.

The pop-up device 16, as noted above, includes the following elements disposed on the tubular body 20: at least one longitudinal race 36 having axial cam surfaces 37, cam surfaces 110 located on the downwardly facing axial surface 31, and a circumferential stop edge 38. The circumferential stop edge 38 is located at the top of each longitudinal race 36. The pop-up device 16 further includes the following elements which are disposed on the guide rod assembly 14: the spindle support body lower end axial surface 66, the at least one bearing 70, and the at least one cam extension 86. The pop-up device 16 further includes a biasing device 100, which is preferably a compression spring 102. The compression spring 102 provides force in a direction generally along, or parallel to, the longitudinal axis of the hose guide 10. The compression spring 102 provides a sufficient force to overcome the static friction between the cam extension angled cam surface 116, described below, and any other angled cam surface 114, 120, also described below.

Figure 4:
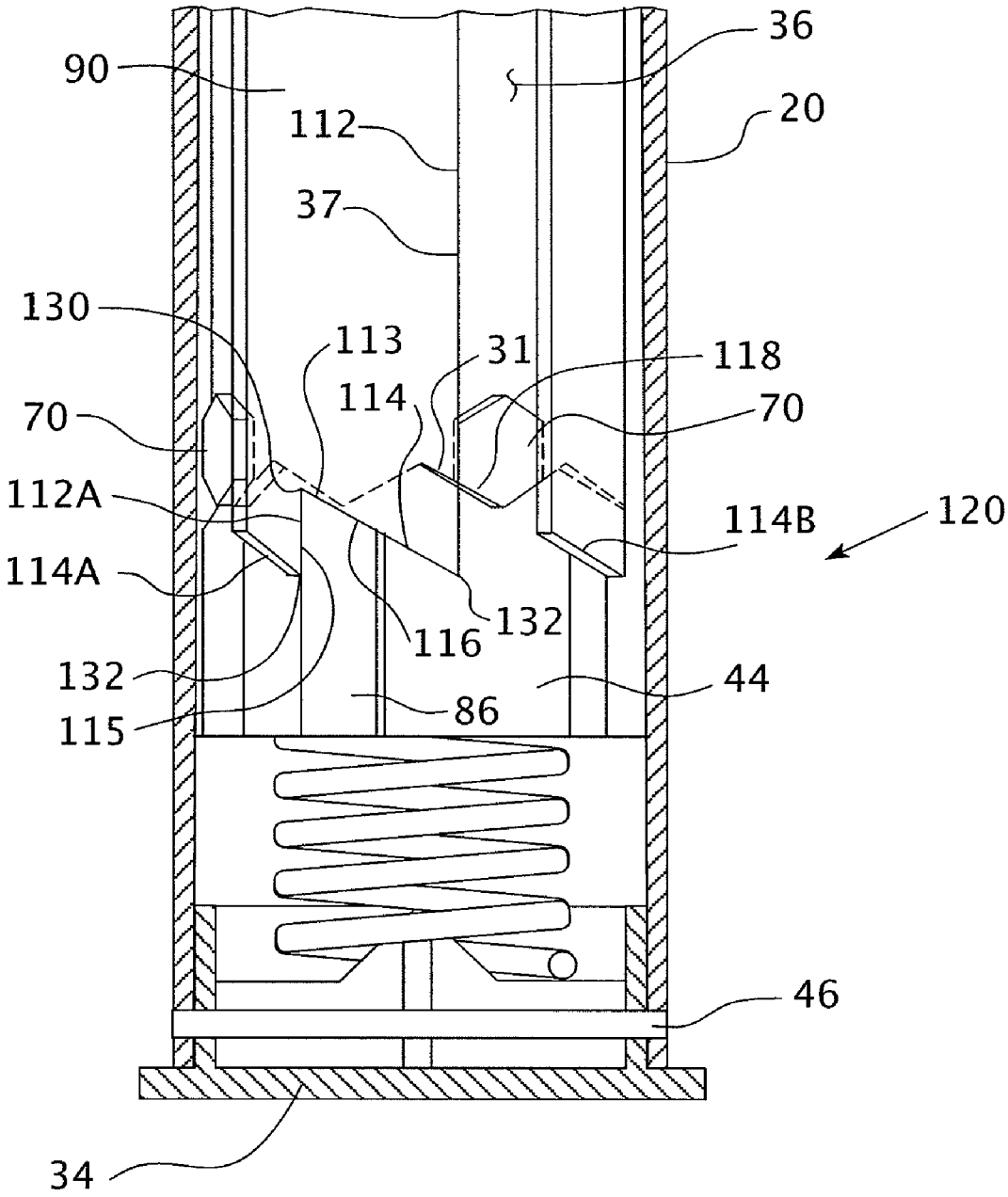
FIG. 4 is a detailed partial cross-sectional side view of the lower portion of a hose guide in a retracted position.

As shown in FIG. 4, the shell assembly cam surfaces 110 are either longitudinal cam surfaces 112 or angled cam surfaces 114. The longitudinal cam surfaces 112 include the race axial surfaces 37. The angle of the shell assembly angled cam surfaces 114 depends upon the number of races 36 and cam extensions 86 utilized. In the preferred embodiment, there are two races 36 and two cam extensions 86. In this configuration, the shell assembly angled cam surfaces 114 are each generally angled between about 15 and 45 degrees, and more preferably, about 30 degrees, relative to a horizontal line extending about the hose guide 10. However, as shown in FIG. 5, four races 36 and four cam extensions 86 may be used.

Similarly, the at least one cam extension 86 includes an angled cam surface 116 that is also generally angled between about 15 and 45 degrees, and more preferably about 30 degrees, relative to a horizontal line extending about the hose guide 10. As such, the at least one cam extension angled cam surface 116 is structured to engage the shell assembly angled cam surfaces 114. The at least one cam extension angled cam surface 116 terminates in a peak 113 that is the highest point of the at least one cam extension 86. The at least one cam extension 86 further includes an axial cam surface 115 extending downwardly from the peak 113 of the at least one cam extension angled cam surface 116.

The spindle support body lower end axial surface 66 also has a plurality of cam surfaces 120 which are generally angled between about 15 and 45 degrees, and more preferably, about 30 degrees, relative to a horizontal line extending about the hose guide 10. The spindle support body lower end axial surface 66 is alternately angled in a "zig-zag" pattern having high points 69 and low points 67. Only those surfaces which are angled to engage the at least one cam extension angled cam surface 116 are spindle support body lower end axial cam surfaces 120. Additionally, the at least one bearing 70 is, in the preferred embodiment, disposed at the spindle support body lower end axial surface 66 and also has a cam surface 118 disposed on the lower side of the at least one bearing 70. This at least one bearing cam surface 118 is also generally angled between about 15 and 45 degrees, and more preferably, about 30 degrees, relative to a horizontal line extending about the hose guide 10.

As noted above, there are preferably two races 36 and two cam extensions 86. The two races 36 are disposed about 180 degrees apart around the tubular body inner side 26. Similarly, the two cam extensions 86 are disposed about 180 degrees apart around the lock cam body lower portion 84. Additionally, there are, in the preferred embodiment, two "first position" longitudinal cam surfaces 112A disposed about 180 degrees apart around the tubular body inner side 26. Each first position longitudinal cam surfaces 112A is disposed at a mid-point between two races 36. The first position longitudinal cam surfaces 112A have a length of between about 0.25 and 0.35 inch, and more preferably, about 0.307 inch. At the highest point on the first position longitudinal cam surfaces 112A, where the first position longitudinal cam surfaces 112A intersect with a shell assembly angled cam surface 114, is an upper notch 130. An upper notch 130 is shaped similar to an inverted "V" having one substantially vertical side. At the lowest point of each longitudinal race axial cam surface 37 and each first position longitudinal cam surfaces 112A is a bottom tip 132. Immediately adjacent to each bottom tip 132 is another adjacent shell assembly angled cam surface 114.

In this configuration, the shell assembly cam surfaces 110 follow a pattern that, when moving around the circumference, may be described as follows: a first position longitudinal cam surface 112A, a shell assembly angled cam surface 114, a longitudinal race 36 having an axial cam surface 37, and a second shell assembly angled cam surface 114A, leading to another first position longitudinal cam surface 112A where the pattern repeats. Finally, it is noted that the spindle support body lower end axial surface 66 is alternately angled in a "zig-zag" pattern and is offset from the shell assembly cam surfaces 110. That is, for example, each low point 67 on the spindle support body lower end axial surface 66 is offset from any first position longitudinal cam surface 112A.

The pop-up device 16 operates as follows. The following description shall address the movement associated with one of the preferred embodiment's two cam extensions 86 as the guide rod assembly 14 moves between the first, retracted position to the second, extended position, and then returns to the first, retracted position. It is understood that the other cam extensions 86 are simultaneously engaging a similar cam surface 110 at another location. When the guide rod assembly 14 is in the first, retracted position, the cam extension 86 is disposed at the upper notch 130. That is, the cam extension axial cam surface 115 is engaging the first position longitudinal cam surface 112A, and the cam extension angled cam surface 116 is engaging a first shell assembly angled cam surface 114. As noted above, the force of the spring 102 is sufficient to overcome the static friction between the cam extension angled cam surface 116 and the first shell assembly angled cam surface 114. Thus, but for the cam extension axial cam surface 115 is engaging the first position longitudinal cam surface 112A, the lock cam 44 would rotate relative to the tubular body 20.

It is further noted that, in this position, the support body lower end axial cam surfaces 120 are disposed above, or parallel to, the first shell assembly angled cam surface 114. The guide rod assembly 14 is maintained in this position by the force of the spring 102. When a user applies pressure to the spindle body platform 53, typically by stepping on the spindle body platform 53, the bias of the spring 102 is overcome and the guide rod assembly 14 moves downwardly. During the downward motion, the support body lower end axial cam surfaces 120 descend below the first shell assembly angled cam surface 114 and a support body lower end axial cam surface low point 67 engages a medial point on the cam extension angled cam surface 116. During this initial downward motion the lock cam 44, along with the spindle assembly 90, moves linearly toward the tubular body lower end 30.

Once the cam extension peak 113 moves below the tubular body axial cam bottom tip 132 the cam extension axial cam surface 115 is no longer engaging the first position longitudinal cam surface 112A. At this point the guide rod assembly 14 is in the transitional position. Once in the transitional position, the force of the spring 102 is sufficient to overcome the static friction between the cam extension angled cam surface 116 and the support body lower end axial cam surface low point 67 causing the lock cam 44 to rotate relative to the tubular body 20. During this rotation, the cam extension angled cam surface 116 slides over the spindle support body lower end axial cam surfaces 120 until the cam extension peak 113 is disposed at the spindle support body lower end axial surface high point 69. This rotational motion, as well as the lock cam 44 snapping into place at the spindle support body lower end axial surface high point 69, produces an audible "click" as well as a vibration that alerts the user that downward force is no longer required. Once the user releases the pressure on the spindle body platform 53 the force of the spring 102 moves the guide rod assembly 14 upwards.

As the guide rod assembly 14 moves upward, the support body lower end axial cam surfaces 120 are moved above the first shell assembly angled cam surface 114. Thus, the cam extension angled cam surface 116 disengages the support body lower end axial cam surfaces 120 and engages the second shell assembly angled cam surface 114A. As the guide rod assembly 14 continues its upward motion, the force of the spring 102 is sufficient to overcome the static friction between the cam extension angled cam surface 116 and the second shell assembly angled cam surface 114A causing the lock cam 44 to rotate relative to the tubular body 20 until the cam extension 86 is aligned with the longitudinal race 36. At this point, the cam extension axial cam surface 115 engages the race axial cam surface 37, which prevents further rotation of the lock cam 44. In this position, the cam extension angled cam surface 116 also abuts the bearing cam surface 118 and the support body lower end axial cam surface low point 67. Once the cam extension 86 is aligned with the longitudinal race 36, the force of the spring 102 moves the guide rod assembly 14 into the second, extended position as the bearing 70 and the cam extension 86 travel upwardly through the race 36. The upward motion of the guide rod assembly 14 is arrested when the bearing 70 engages the circumferential stop edge 38. At this point, the guide rod assembly 14 is in the second, extended position.

When the user no longer needs the guide rod assembly 14 in the second, extended position, the user again applies force to the spindle body platform 53 sufficient to overcome the force of the spring 102. This causes the guide rod assembly 14 to move back into the tubular body enclosed space 22 with the bearing 70 and the cam extension 86 traveling downwardly through the race 36. As the guide rod assembly 14 moves toward the intermediate position, the support body lower end axial cam surfaces 120 descends below the second shell assembly angled cam surface 114A. Just after the support body lower end axial cam surfaces 120 descends below the other first shell assembly angled cam surface 114A, the cam extension peak 113 moves below the tubular body axial cam bottom tip 132 located at the bottom of the race 36. With the cam extension axial cam surface 115 no longer restrained by the race axial cam surface 37, the force of the spring 102 acting upon the angled cam surfaces again causes the lock cam 44 to rotate relative to the tubular body 20. As the lock cam 44 rotates the cam extension angled cam surface 116 slides over the spindle support body lower end axial cam surfaces 120 and the bearing cam surface 118 until the cam extension peak 113 is disposed at the spindle support body lower end axial surface high point 69. Again, there is an audible "click" and/or a vibration that alerts the user that the downward force is no longer required. As the user stops applying pressure to the spindle body platform 53, the spring 102 moves the guide rod assembly 14 upward.

As the guide rod assembly 14 moves upward, the cam extension angled cam surface 116 engages a third shell assembly angled cam surface 114B, leading to another first position longitudinal cam surface 112A. At the same time, the support body lower end axial cam surfaces 120 ascends above the third shell assembly angled cam surface 114B. Thus, the cam extension angled cam surface 116 only engages the third shell assembly angled cam surface 114B, and as the upward motion of the guide rod assembly 14 continues, the cam extension 86 is again disposed at an upper notch 130. In this position, the guide rod assembly 14 is again in the first, retracted position, and the cycle may be repeated. In this configuration, the pop-up device 16 is structured to be actuated by a generally linear movement of the guide rod assembly 14.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A hose guide comprising:

a shell assembly having a tubular body, said tubular body defining a substantially enclosed space and an opening into said enclosed space;

a guide rod assembly, said guide rod assembly movably coupled to said shell assembly and structured to move between a first, retracted position, wherein said guide rod assembly is substantially disposed within said shell assembly enclosed space, and a second, extended position, wherein said guide rod assembly extends substantially above said shell assembly enclosed space;

a pop-up device having elements disposed on said shell assembly and on said guide rod assembly, said pop-up device structured to move said guide rod assembly between said first, retracted position and said second, extended position; and said pop-up device structured to be actuated by a generally linear movement of said guide rod assembly.

2. The hose guide of claim 1 wherein:

said tubular body has a sidewall with an elongated, generally cylindrical shape; and said guide rod assembly is generally cylindrical.

3. The hose guide of claim 2 wherein:

said tubular body has a generally uniform diameter, an inner side, an upper end, and a lower end;

said shell assembly opening is disposed on the axial side of said tubular body upper end; and said tubular body lower end includes a rounded end cap.

4. The hose guide of claim 2 wherein:

said pop-up device includes at least one race disposed on said shell assembly inner side;

said pop-up device includes at least one bearing disposed on said guide rod assembly; and said at least one bearing structured to be movably disposed in said race.

5. The hose guide of claim 4 wherein said at least one race is generally straight and extends longitudinally.

6. The hose guide of claim 5 wherein said pop-up device includes a biasing device, said biasing device structured to bias said guide rod assembly toward said second, extended position.

7. The hose guide of claim 6 wherein:

said guide rod assembly includes a spindle assembly and a lock cam;

said spindle assembly having a hollow, elongated, generally cylindrical body with an upper end, a lower end, and a lower axial surface;

said at least one bearing disposed upon the outer surface of said spindle assembly;

said pop-up device includes said spindle assembly lower axial surface having an alternately angled cam surface;

said lock cam having an elongated, generally cylindrical body with an upper portion, a lower portion, and at least one cam extension;

said cam extension extending radially from said lock cam lower portion, said pop-up device includes said cam extension having an angled cam surface;

said lock cam upper portion structured to be disposed within said spindle support hollow body;

wherein, when said lock cam upper portion is disposed within said spindle assembly hollow body, said at least one cam extension engages said spindle assembly lower axial surface;

said tubular body has an inner side, an upper end, and a lower end; and said biasing device is a spring, said spring disposed between said guide rod assembly and said shell assembly lower end.

8. The hose guide of claim 7 wherein said spindle assembly does not rotate relative to said shell assembly.

9. The hose guide of claim 7 wherein:

said spindle assembly includes top platform disposed at said spindle assembly upper end; and said top platform having a greater cross-sectional area than said spindle assembly body.

10. The hose guide of claim 9 wherein:

said shell assembly collar body is flared, said flared collar body having a cross-sectional area larger than said spindle assembly top platform;

wherein said spindle assembly may be moved partially into said tubular body flared upper end; and wherein said guide rod assembly moves through an intermediate position between said first position and said second position, said intermediate position occurring when said spindle assembly top platform is disposed within said collar body.

11. The hose guide of claim 1 wherein said guide rod assembly moves through an intermediate position between said first position and said second position, said intermediate position occurring when said guide rod assembly is disposed entirely within said shell assembly enclosed space.

12. A hose guide comprising:

a shell assembly defining a substantially enclosed space and having an opening into said enclosed space;

a guide rod assembly, said guide rod assembly movably coupled to said shell assembly and structured to move between a first, retracted position, wherein said guide rod assembly is substantially disposed within said shell assembly enclosed space, and a second, extended position, wherein said guide rod assembly extends through said shell assembly opening and substantially above said shell assembly enclosed space;

a pop-up device, said pop-up device structured to move said guide rod assembly between said first, retracted position and said second, extended position; and said pop-up device structured to be actuated by a generally linear movement of said guide rod assembly.

13. The hose guide of claim 12 wherein:

said guide rod assembly is elongated; and said pop-up device being structured to be actuated by a generally axial movement of said guide rod assembly.

* * * * *

UNITED STATES PATENT AND TRADEMARK OFFICE

CERTIFICATE OF CORRECTION

PATENT NO. : 7,997,525 B2
APPLICATION NO. : 12/913866
DATED : August 16, 2011
INVENTOR(S) : Stephen D. Hatcher et al.

It is certified that error appears in the above-identified patent and that said Letters Patent is hereby corrected as shown below:

Column 1, line 34, “post” should read --post,--.
Column 7, line 38, “cam 44 rotates the cam” should read --cam 44 rotates, the cam--.
Column 7, line 51, “ascends” should read --ascend--.

Signed and Sealed this
Twenty-seventh Day of December, 2011

David J. Kappos

David J. Kappos
*Director of the United States Patent and Trademark Office*